US010822781B2

(12) United States Patent
Sage-Passant

(10) Patent No.: US 10,822,781 B2
(45) Date of Patent: Nov. 3, 2020

(54) WALL-MOUNTED WASH BASIN

(71) Applicant: MECHLINE DEVELOPMENTS LIMITED, Milton Keynes (GB)

(72) Inventor: Peter Sage-Passant, Milton Keynes (GB)

(73) Assignee: Mechline Developments Limited (GB)

( * ) Notice: Subject to any disclaimer, the term of this patent is extended or adjusted under 35 U.S.C. 154(b) by 0 days.

(21) Appl. No.: 16/308,272

(22) PCT Filed: May 31, 2017

(86) PCT No.: PCT/GB2017/051550
§ 371 (c)(1),
(2) Date: Dec. 7, 2018

(87) PCT Pub. No.: WO2017/212220
PCT Pub. Date: Dec. 14, 2017

(65) Prior Publication Data

US 2019/0257063 A1 Aug. 22, 2019

(30) Foreign Application Priority Data

Jun. 8, 2016 (GB) ..... 1609974.9

(51) Int. Cl.

| | |
|---|---|
| ***E03C 1/322*** | (2006.01) |
| ***A47K 1/04*** | (2006.01) |
| ***E03C 1/18*** | (2006.01) |
| ***E03C 1/33*** | (2006.01) |

(52) U.S. Cl.
CPC ..... *E03C 1/322* (2013.01); *A47K 1/04* (2013.01); *E03C 1/18* (2013.01); *E03C 1/33* (2013.01)

(58) Field of Classification Search
USPC ..... 4/650
See application file for complete search history.

(56) References Cited

U.S. PATENT DOCUMENTS 2,029,089 A * 1/1936 Weirauch ..... E03C 1/322 248/223.21
3,364,503 A * 1/1968 Mustee ..... E03C 1/322 4/647

(Continued)

FOREIGN PATENT DOCUMENTS

DE 1 959 973 6/1971
DE 29 18 617 11/1980

(Continued)

OTHER PUBLICATIONS

International Search Report dated Oct. 16, 2017 for International Application No. PCT/GB2017/051550.

(Continued)

*Primary Examiner* — Huyen D Le
(74) *Attorney, Agent, or Firm* — Fay Sharpe LLP

(57) ABSTRACT

A wash basin (2) includes a bowl unit (4) and a skirt (6) that supports the bowl unit. The bowl unit (2) is made mainly or entirely of metal and the skirt (6) is made mainly or entirely of a moulded thermoplastic material. The skirt (6) includes a peripheral rim (28) that is located beneath an edge portion (29) of the bowl unit to support that bowl unit, and the bowl unit (4) and the skirt (6) are bonded together.

18 Claims, 4 Drawing Sheets

(56) References Cited

U.S. PATENT DOCUMENTS

| | | | | |
|---|---|---|---|---|
| 3,487,478 | A * | 1/1970 | Harris | A47K 1/08 4/619 |
| 3,915,524 | A * | 10/1975 | Langston | E03C 1/32 312/204 |
| 5,016,297 | A | 5/1991 | Sauter et al. | |
| 6,311,345 | B1 | 11/2001 | Limbach | |
| 2004/0083546 | A1 | 5/2004 | Tahara et al. | |
| 2012/0151672 | A1* | 6/2012 | Bucher | A47K 1/04 4/650 |
| 2018/0355596 | A1* | 12/2018 | Hornback | E03C 1/33 |

FOREIGN PATENT DOCUMENTS

| | | |
|---|---|---|
| DE | 20 2004 004261 U1 | 7/2004 |
| EP | 0 307 825 A1 | 3/1989 |
| FR | 2 938 563 | 5/2010 |
| JP | 2001 340146 | 12/2001 |

OTHER PUBLICATIONS

Written Opinion dated Oct. 16, 2017 for International Application No. PCT/GB2017/051550.

International Preliminary Report on Patentability dated Dec. 11, 2018 for International Application No. PCT/GB2017/051550.

British Search Report dated Nov. 23, 2016 for Application No. GB1609974.9.

Halsey Taylor Owners Manual, HTV Series Barrier-Free Water Coolers, No. 97702C, Rev. Aug. 2005.

plumbingsupply.com, "Voyager HTV Series Filtered Water Coolers", published Aug. 18, 2015, Halsey-Taylor. Available from https://web.archive.org/web/20150818025725/https://www.plumbingsup ply.com/filtered_drinkingfountains.html.

* cited by examiner

WALL-MOUNTED WASH BASIN

FIELD OF INVENTION

The present invention relates to a wash basin and in particular to a wash hand basin that is designed for use in commercial kitchens and similar commercial establishments.

BACKGROUND

Wash hand basins designed for use in commercial kitchens are usually of all stainless steel construction and typically consist of a bowl and deck made of 304 grade austenitic stainless steel, and a skirt that is made of a lower grade ferritic steel. Ferritic steel is usually chosen for the skirt because it is a lower cost material than the austenitic stainless steel used for the bowl and deck, but has a lower corrosion resistance. The bowl and the skirt are usually bolted or riveted together to form the basin.

The ferritic steel used for the skirt is difficult to form into complex curved shapes. The skirt therefore tends to have a simple square box shape with flat sides and sharp corners. This makes it difficult to clean. The use of bolts or rivets to fasten the basin to the skirt also causes cleaning problems, particularly where sterile conditions are required, for example in hospital ward kitchens or laboratories. The corners tend to protrude and can be easily knocked into by the user, causing an injury. Also, without thorough deburring, the steel panels forming the skirt can have very sharp edges, which can cause a cut hazard when cleaning.

Creating an all stainless steel hand wash basin with a curved front and fully deburred edges is possible but expensive. Accordingly, such a basin may not be considered suitable for many kitchen installations.

SUMMARY OF THE INVENTION

It is an object of the present invention to provide a wash hand basin that mitigates one or more of the aforesaid problems.

According to one aspect of the present invention there is provided a wash basin that includes a bowl unit, a skirt that supports the bowl unit, and a mounting bracket for mounting the skirt on a substantially vertical wall or support structure, wherein the bowl unit is made mainly or entirely of metal and the skirt comprises a unitary moulding made mainly or entirely of a thermoplastic material, wherein the skirt includes a peripheral rim that is located beneath an edge portion of the bowl unit to support the bowl unit, and wherein the bowl unit and the skirt are bonded together around the peripheral rim of the skirt.

By forming the skirt as a unitary moulding using a thermoplastic material, we have been able to provide a basin that has no sharp corners, joints or edges, is easy to clean and does not cause a cut hazard. By describing the skirt as a "unitary moulding" we mean that it is moulded as a single component. The skirt can also be coloured by adding a colouring agent to the thermoplastic material, which can be important where cross-contamination needs to be avoided and where certain operatives can only use certain equipment, for example in laboratories. By bonding the bowl unit to the skirt we have avoided the use of fasteners such as bolts or rivets, which makes cleaning easier, particularly where sterile conditions are needed. The skirt can be made to any desired shape and does not require deburring. The basin can also have a very pleasing appearance, while also being strong, hard-wearing and meeting all necessary functional requirements. The basin can also be manufactured at relatively low cost, as expensive metal shaping processes are avoided.

In the present invention, we specify that the bowl unit is made mainly or entirely of metal and the skirt is made mainly or entirely of a moulded thermoplastic material. By the term "mainly or entirely" we mean that the bowl is made either entirely of metal, or it is made mostly of metal (as an example, at least 60%, and preferably at least 70%, 80% or 90% metal by weight). It will be appreciated of course that the basin may also include some parts that are made of other materials.

Similarly, by specifying that the skirt is made mainly or entirely of a moulded thermoplastic material, we mean that it is made either entirely of a moulded thermoplastic material, or it is made mostly of a moulded thermoplastic material (as an example, at least 60%, and preferably at least 70%, 80% or 90% by weight). It will be appreciated of course that the skirt may also include some parts that are made of other materials. These parts may for example be attached to the skirt after it has been moulded, or incorporated into the skirt during the moulding process.

In an embodiment, the bowl unit is made mainly or entirely of stainless steel, preferably for example an austenitic stainless steel, which is highly corrosion-resistant, durable, easy to clean and attractive in appearance.

In an embodiment, the skirt is made mainly or entirely of an ABS/Polycarbonate material, which has good mechanical properties (for example, it is strong and durable), can be moulded into numerous forms, and is easy to clean and attractive in appearance.

In an embodiment, the skirt comprises an injection moulded part.

The bowl unit and the skirt are bonded together around the peripheral rim of the skirt, thereby forming a very solid and robust basin unit.

In an embodiment, the skirt includes a substantially vertically wall that is located in use in a rear region of the basin, for attachment by the mounting bracket to a substantially vertical wall or support structure.

In an embodiment, the skirt includes a curved portion that is located in use in a front region of the basin.

In an embodiment, the bowl unit includes a bowl portion and a deck that extends around the bowl portion.

In an embodiment, the deck includes a downturned wall that extends around the peripheral rim of the skirt.

In an embodiment, the skirt includes a support structure that extends beneath and supports the bowl portion of the bowl unit.

In an embodiment, the bowl portion is bonded to the support structure.

In an embodiment, the bowl unit and the skirt are bonded together with a bonding material, for example an epoxy resin.

In an embodiment, the deck includes an upstanding rear wall at a rear edge of the deck.

In an embodiment, the basin includes an outlet spout and a valve assembly that controls a flow of water to the spout.

In an embodiment, the valve assembly is operable by a control device located adjacent a front portion of the skirt. This allows hands-free operation of the valve.

In an embodiment, the valve assembly is configured to allow a flow of water for a predetermined time.

In an embodiment, the mounting bracket includes a spirit level, to aid correct levelling of the basin.

BRIEF DESCRIPTION OF THE DRAWINGS

An embodiment of the invention will now be described, by way of example, with reference to the accompanying drawings, in which.

DETAILED DESCRIPTION

Figure 1:
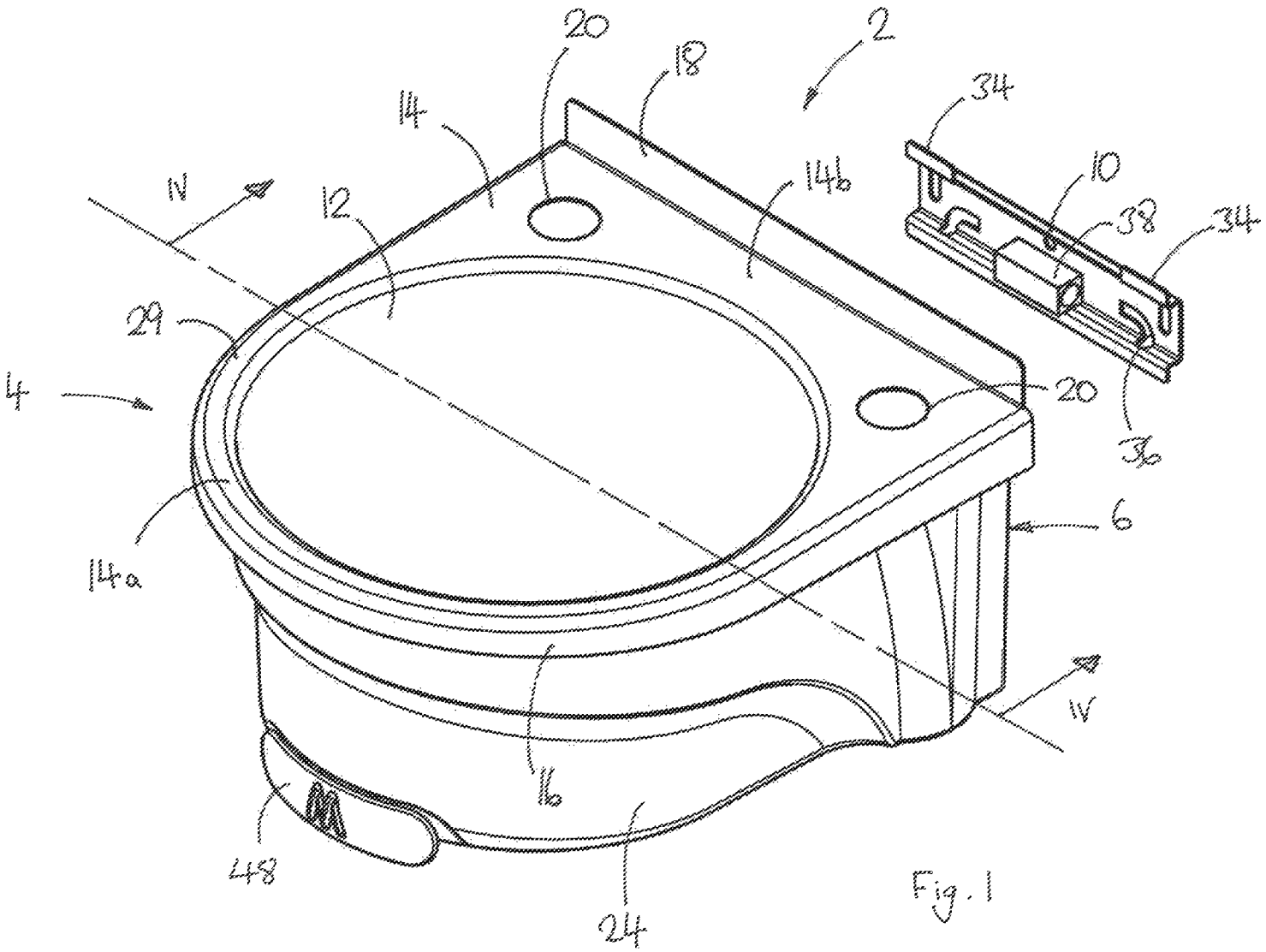
FIG. 1 is an isometric view of a hand wash basin according to an embodiment of the invention, together with a mounting bracket.
Figure 2:
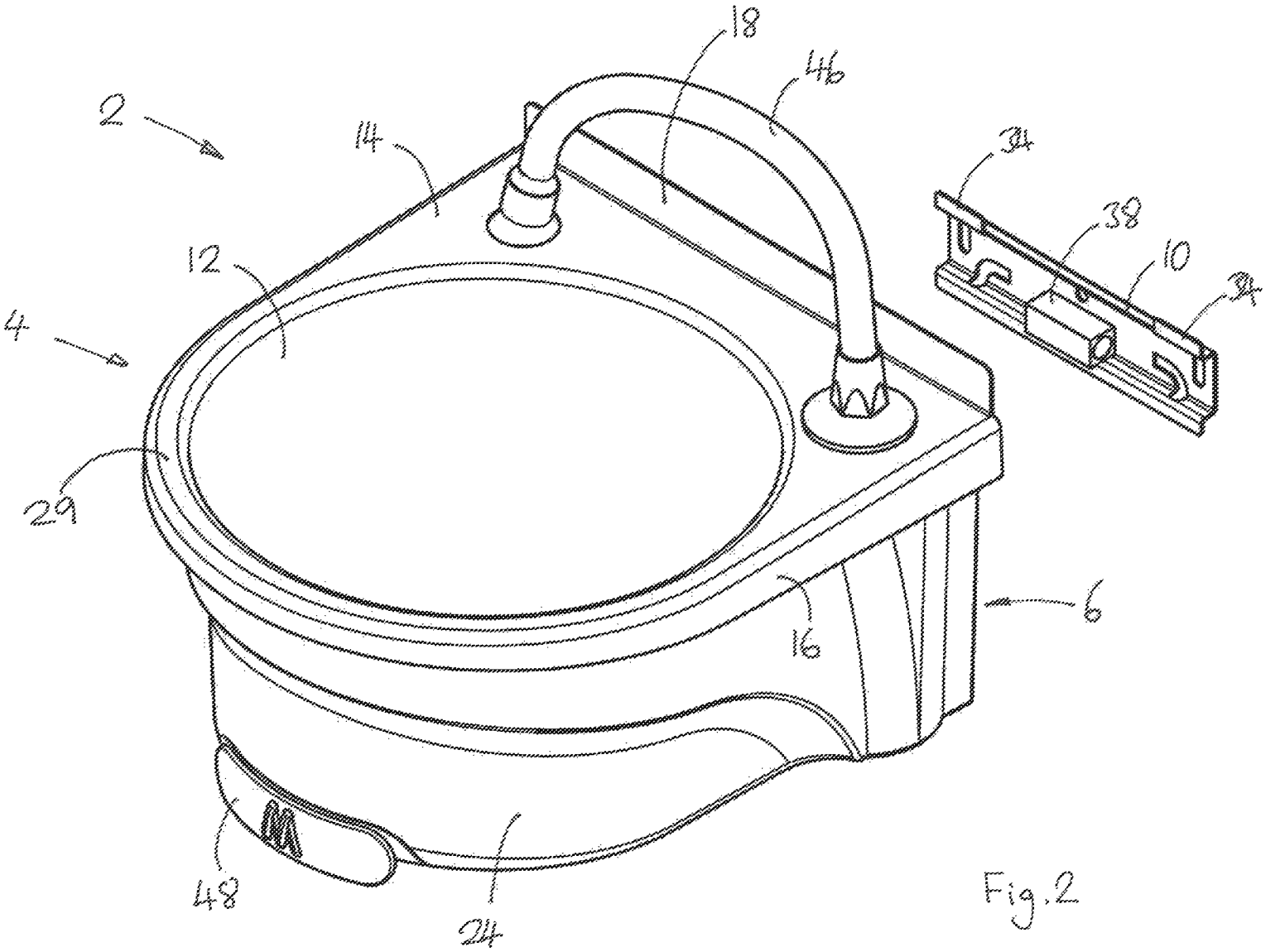
FIG. 2 is an isometric view of the hand wash basin fitted with a water spout, together with a mounting bracket.
Figure 3:
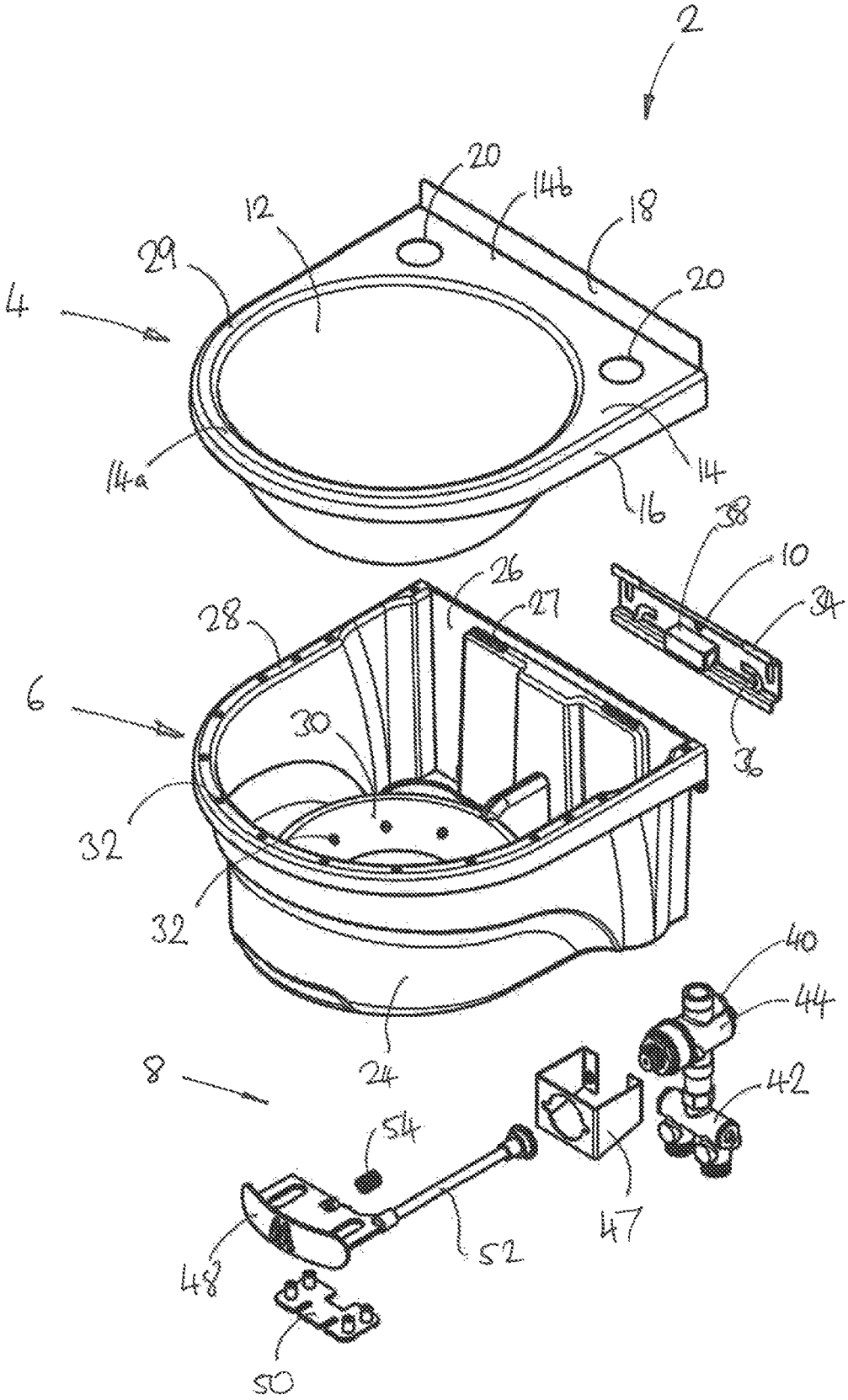
FIG. 3 is a exploded isometric view of the hand wash basin, showing the main components of the basin.
Figure 4:
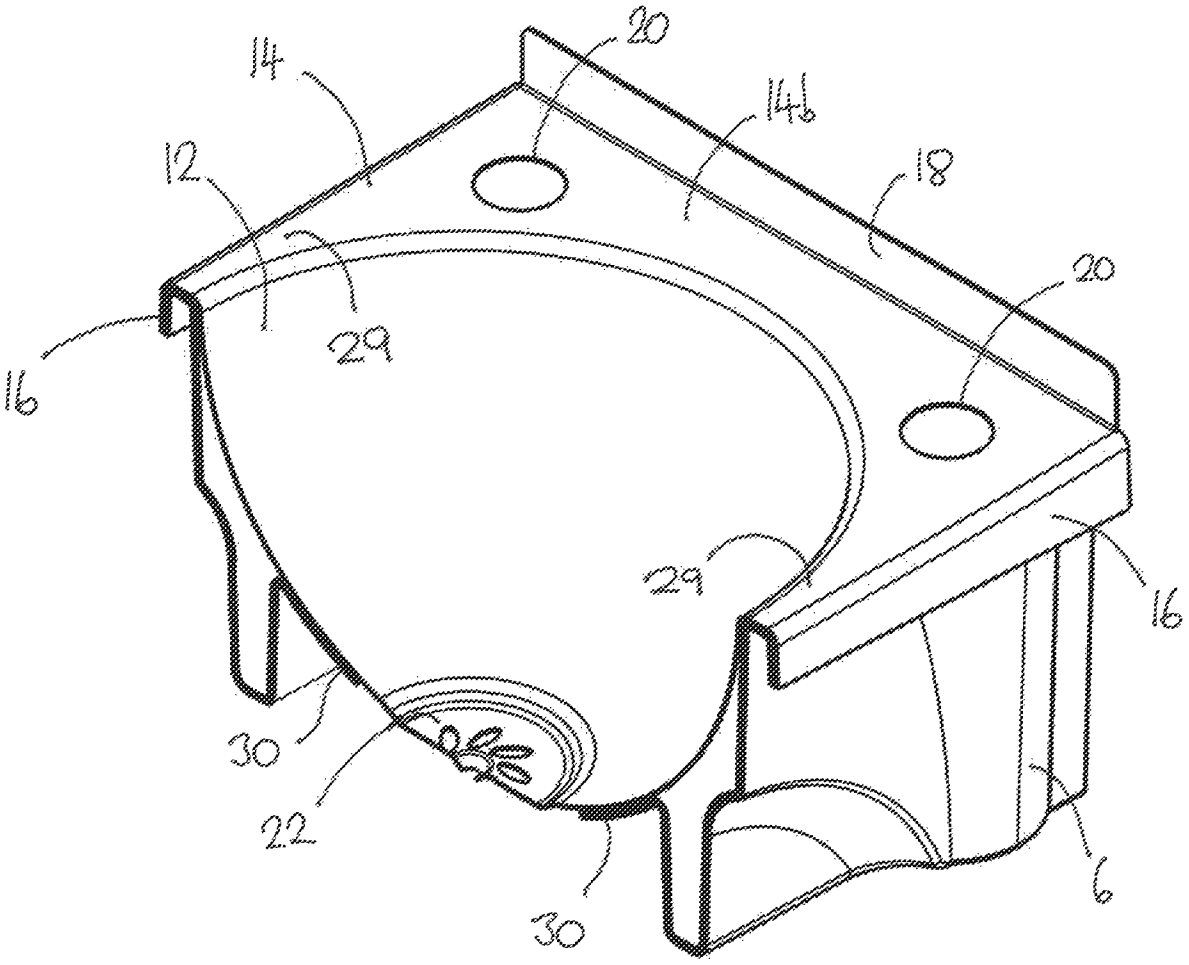
FIG. 4 is a sectional view online IV-IV of FIG. 1.

As shown in the drawings, the hand wash basin 2 includes a bowl unit 4, a skirt 6, a valve assembly 8 and a mounting bracket 10.

The bowl unit 4 is preferably made of stainless steel, for example preferably a polished high grade 304 austenitic stainless steel, and comprises a bowl portion 12, a deck 14, a down-turned wall 16 that extends around the side and front edges of the deck 14, and a rear wall 18 that extends upwards from the rear edge of the deck 14. In this embodiment the bowl portion 12 is part-spherical and the deck 14 includes a semi-circular front part 14*a* and a substantially rectangular rear part 14*b*. The bowl portion 12 and the deck 14 may alternatively take other shapes.

The deck 14 may be provided in the rear part 14*b* with one or more mounting holes 20 for taps or water spouts. A drain hole 22 is provided in the lowest part of the bowl portion 12. Optionally, the rear wall 18 may be extended upwards to provide an integral splashback.

The skirt 6 comprises a unitary moulding that is made of a thermoplastic material. For example, it may be made by injection moulding, preferably using a high strength thermoplastic material. In a preferred embodiment the skirt is made from a blended ABS/polycarbonate material, which may optionally include a fibrous reinforcing material.

The skirt 6 provides a support structure for the bowl unit 4. In the illustrated embodiment, the skirt 6 includes a curved peripheral wall 24 that extends around the sides and front of the basin 2, and a substantially vertical rear wall 26. The rear wall 26 includes mounting formations 27 that can be engaged with the mounting bracket 10, allowing the skirt 6 to be attached to a supporting wall of a kitchen or other room in which the basin is installed.

The skirt 6 is matched to the shape of the bowl unit 4 and the upper edge of the peripheral wall 24 provides a rim 28 that is located beneath an edge portion 29 of the bowl unit 4, adjacent the down-turned wall 16. In the assembled basin the down-turned wall 16 covers the rim 28 and the upper part of the skirt 6.

In the lower part of the skirt 6 a further support structure 30 is provided, which engages and supports the lower part of the bowl portion 12. Holes 32 are provided in the rim 28 and the support structure 30, allowing a bonding agent, for example an epoxy resin, to be injected between the skirt 6 and the bowl unit 4 to bond the two components together.

The mounting bracket 10 is made for example of pressed stainless steel and includes mounting formations 34 that are engageable with the mounting formations 27 of the skirt 6, and holes 36 for screws or other fasteners, allowing it to be attached to a wall. The mounting bracket 10 also preferably includes an integral spirit level 38 that can be used during installation to ensure that it is correctly levelled.

In this embodiment the valve assembly 8 includes a valve unit 40 that includes a mixer unit 42 for mixing hot and cold water supplies and a stop valve 44 that controls the flow of water to an outlet spout 46. The valve unit 40 is secured to the skirt 6 by a mounting bracket 47. The stop valve 44 is operated by a push bar 48 mounted beneath the front edge of the skirt 6 by a push bar bracket 50. The push bar 48 is connected to the stop valve 44 by a push rod 52. A compression spring 54 is mounted between the skirt 6 and the push bar 48 and is arranged to urge the push bar 48 outwards to a position in which the stop valve 44 is closed.

The stop valve 44 is normally closed but may be opened by pressing the push bar 48 to permit a flow of water to the spout 46. The push bar 48 is located below the front part of the skirt 6 so that it can be pressed with a leg or knee, thus allowing hands-free use of the basin 2. The stop valve 44 may be configured to close immediately when pressure on the push bar 48 is released, or it may include a delay mechanism allowing continued water flow for a predetermined time after the push bar 48 has been released. The compression spring 54 returns the push bar 48 to the "off" position after it has been pressed by a user.

Alternatively the basin 2 may be provided with an electronically-actuated stop valve, which opens whenever a user's hands are detected in the vicinity of the basin (for example using an infrared or ultrasound sensor), or a manually operated tap or taps may be provided.

The invention claimed is:

1. A wash basin that includes a bowl unit, a skirt that supports the bowl unit, and a mounting bracket for mounting the skirt on a substantially vertical wall or support structure, wherein the bowl unit is made mainly or entirely of metal and the skirt comprises a unitary moulding made mainly or entirely of a thermoplastic material, wherein the bowl unit includes a bowl portion and a deck that extends around the bowl portion, wherein the skirt comprises a peripheral wall that extends around sides and a front of the bowl portion, wherein an upper edge of the peripheral wall comprises a peripheral rim that is located beneath the deck to support the bowl unit, and wherein the deck includes a downturned wall that extends around the peripheral rim and covers the peripheral rim and an upper part of the skirt, wherein the bowl unit and the skirt are bonded together around the peripheral rim of the skirt, and wherein the skirt and the mounting bracket include mounting formations that are engageable for mounting the skirt to the mounting bracket.

2. A wash basin according to claim 1, wherein the bowl unit is made mainly or entirely of stainless steel.

3. A wash basin according to claim 2, wherein the skirt is made mainly or entirely of an ABS/Polycarbonate material.

4. A wash basin according to claim 3, wherein the skirt comprises an injection moulded part.

5. A wash basin according to claim 4, wherein the skirt includes a substantially vertically wall that is located in use in a rear region of the wash basin, for attachment by the mounting bracket to a substantially vertical wall or support structure.

6. A wash basin according to claim 5, wherein the skirt includes a curved portion that is located in use in a front region of the wash basin.

7. A wash basin according to claim 1, wherein the skirt is made mainly or entirely of an ABS/Polycarbonate material.

8. A wash basin according to claim 1, wherein the skirt comprises an injection moulded part.

9. A wash basin according to claim 1, wherein the skirt includes a substantially vertically wall that is located in use in a rear region of the wash basin, for attachment by the mounting bracket to a substantially vertical wall or support structure.

10. A wash basin according to claim 1, wherein the skirt includes a curved portion that is located in use in a front region of the wash basin.

11. A wash basin according to claim 1, wherein the skirt includes a support structure that extends beneath and supports the bowl portion of the bowl unit.

12. A wash basin according to claim 11, wherein the bowl portion is bonded to the support structure.

13. A wash basin according to claim 1, wherein the bowl unit and the skirt are bonded together with a bonding material.

14. A wash basin according to claim 1, wherein the deck includes an upstanding rear wall at a rear edge of the deck.

15. A wash basin according to claim 1, wherein the wash basin includes an outlet spout and a valve assembly that controls a flow of water to the spout.

16. A wash basin according to claim 15, wherein the valve assembly is operable by a control device located adjacent a front portion of the skirt.

17. A wash basin according to claim 15, wherein the valve assembly is configured to allow a flow of water for a predetermined time.

18. A wash basin according to claim 1, wherein the mounting bracket includes a spirit level.

* * * * *